US006688325B2

(12) United States Patent
Hettinger

(10) Patent No.: US 6,688,325 B2
(45) Date of Patent: Feb. 10, 2004

(54) MODULAR FLUID CONTROL SYSTEM

(75) Inventor: Christoph Hettinger, Ingenfingen (DE)

(73) Assignee: Burkert Werke GmbH & Co. (DE)

( * ) Notice: Subject to any disclaimer, the term of this patent is extended or adjusted under 35 U.S.C. 154(b) by 284 days.

(21) Appl. No.: 09/863,588

(22) Filed: May 22, 2001

(65) Prior Publication Data

US 2002/0020445 A1 Feb. 21, 2002

(30) Foreign Application Priority Data

May 23, 2000 (DE) ..... 200 09 234 U

(51) Int. Cl.[7] ..... F17D 1/00
(52) U.S. Cl. ..... 137/270; 137/884
(58) Field of Search ..... 137/270, 271, 137/884

(56) References Cited

U.S. PATENT DOCUMENTS

| | | | |
|---|---|---|---|
| 3,516,436 A | 6/1970 | Klaus et al. | |
| 3,605,805 A | 9/1971 | Worrix | |
| 5,860,676 A | 1/1999 | Brzezicki et al. | |
| 6,199,590 B1 * | 3/2001 | Ferretti | 137/270 X |
| 6,302,141 B1 * | 10/2001 | Markulec et al. | 137/884 X |

FOREIGN PATENT DOCUMENTS

| | | |
|---|---|---|
| DE | 24 32 835 | 7/1974 |
| DE | 27 50 035 | 11/1977 |
| JP | 63-290465 | 11/1988 |

* cited by examiner

*Primary Examiner*—Kevin Lee
(74) *Attorney, Agent, or Firm*—Nixon & Peabody LLP; Stuart J. Friedman

(57) ABSTRACT

A modular fluid control system which comprises a plurality of fluid distribution modules each formed of a parallelepiped-shaped module block of similar shape and size and having fluid channels therein is provided. Each module block has at least two porting faces on opposite sides, selected ones of the channels opening on an associated one of the porting faces to form port openings. The module blocks are arranged in an aligned abutting relationship so that selected port openings communicate with each other at abutting porting faces of adjacent module blocks. The modular fluid control system further comprises a frame which surrounds the module blocks and has connector through ports therein aligned with selected ones of the port openings.

13 Claims, 5 Drawing Sheets

MODULAR FLUID CONTROL SYSTEM

TECHNICAL FIELD

The present invention relates to a modular fluid control system which comprises a plurality of fluid distribution modules. Each fluid distribution module is formed of a parallelepiped-shaped module block of similar shape and size and inside the module blocks fluid channels are provided.

BACKGROUND OF THE INVENTION

Modular fluid control systems comprising a plurality of module blocks of similar shape and size are for example used in the field of analytical procedures. German utility model No. 297 03 788.8 discloses a modular fluid control system for use in the field of analytical procedures which comprises a plurality of module blocks. The module blocks may be arranged in-line or staggered, with different function modes being achieved by either an in-line or a staggered arrangement of the module blocks. In order to reduce the manufacturing costs of the modular fluid control system, all module blocks are embodied with the same outer shape. Thus, only a single die mould has to be produced and the module blocks can be made in large production batches. Differences regarding the design of the fluid channels may be achieved by a simple replacement of interchangeable shutters in the die mould.

BRIEF SUMMARY OF THE INVENTION

The invention provides a modular fluid control system which mainly consists of standardized components allowing a simple and cost-effective mounting and considerable freedom as to the configuration of the modular fluid control system.

According to a first aspect of the invention a modular fluid control system is provided which comprises a plurality of fluid distribution modules each formed of a parallelepiped-shaped module block of similar shape and size and having fluid channels therein. Each module block has at least two porting faces on opposite sides and selected ones of the fluid channels open on an associated one of the porting faces to form port openings. The module blocks are arranged in an aligned abutting relationship so that selected port openings communicate with each other at abutting porting faces of adjacent module blocks. The modular fluid control system further comprises a frame which surrounds the module blocks and has connector through ports therein aligned with selected ones of the port openings.

As each module block has the same standard size and shape and has at least two porting faces on opposite sides it is possible to arrange the module blocks in any desired sequence without having to take into consideration whether a module block abuts an adjacent module block, or blocks, on its left or right side or on both sides . This allows a great flexibility with respect to the arrangement of the module blocks. The porting faces of each module block are not only intended to be interfaces to adjacent module blocks but also to be interfaces to connection elements directing the fluid into or out of the modular fluid control system. For this purpose the frame is provided with connector through ports aligned with selected ones of the port openings of the porting faces. Thus the frame has the functions both to localize each module block with respect to the other ones and to provide a simple and reliable solution for the accommodation of connection elements.

In a preferred embodiment according to the first aspect of the invention, the frame is assembled of a plurality of inter-engaged frame members. The frame members preferably comprise side members and end members which each are configured of the same size and shape. Thus the same type of frame members can be used for each modular fluid control system, independent of the number and sequence of the module blocks arranged therein. This results in low production costs because the frame members, like the module blocks, can be made in large production batches.

A further advantage of the inter-engaged frame members is the possibility to subsequently change the number or sequence of the module blocks of an assembled modular fluid control system by simply releasing the connection between an end member and the adjacent side members.

According to a second aspect of the invention a modular fluid control system is provided which comprises a plurality of fluid distribution modules each formed of a parallelepiped-shaped module block of similar shape and size and having fluid channels therein. Each module block has at least one porting face. Selected ones of the channels open on an associate porting face to form port openings. The modular fluid control system further comprises a central manifold block with peripheral porting faces. The module blocks are arranged about the central manifold block so that each module block has a porting face abutting a corresponding porting face of the manifold block.

According to this aspect different control functions of the modular fluid control systems can be achieved by simply exchanging the central manifold block, for example by using a central manifold block with a different flow of fluid channels.

According to a third aspect of the invention a modular fluid control system is provided which comprises a plurality of fluid distribution modules each formed of a parallelepiped-shaped module block of similar shape and size and having fluid channels therein. Each module block has a bottom face with port openings where the channels open. The modular fluid control system further comprises a common manifold base which is provided with port openings for communication with corresponding port openings of the module blocks.

According to the third aspect of the invention different control functions of the modular fluid control systems can be achieved by simply exchanging the common manifold base or by changing the arrangement of the module blocks on the common manifold base. Different manifold bases may for example differ in the arrangement and number of the port openings, thus requiring a different number of module blocks which are arranged in a different orientation with respect to each other.

BRIEF DESCRIPTION OF THE DRAWINGS

Further features and advantages of the invention read from the following description of four advantageous embodiments and with reference to the attached drawings in which.

DETAILED DESCRIPTION OF THE INVENTION

Figure 1:
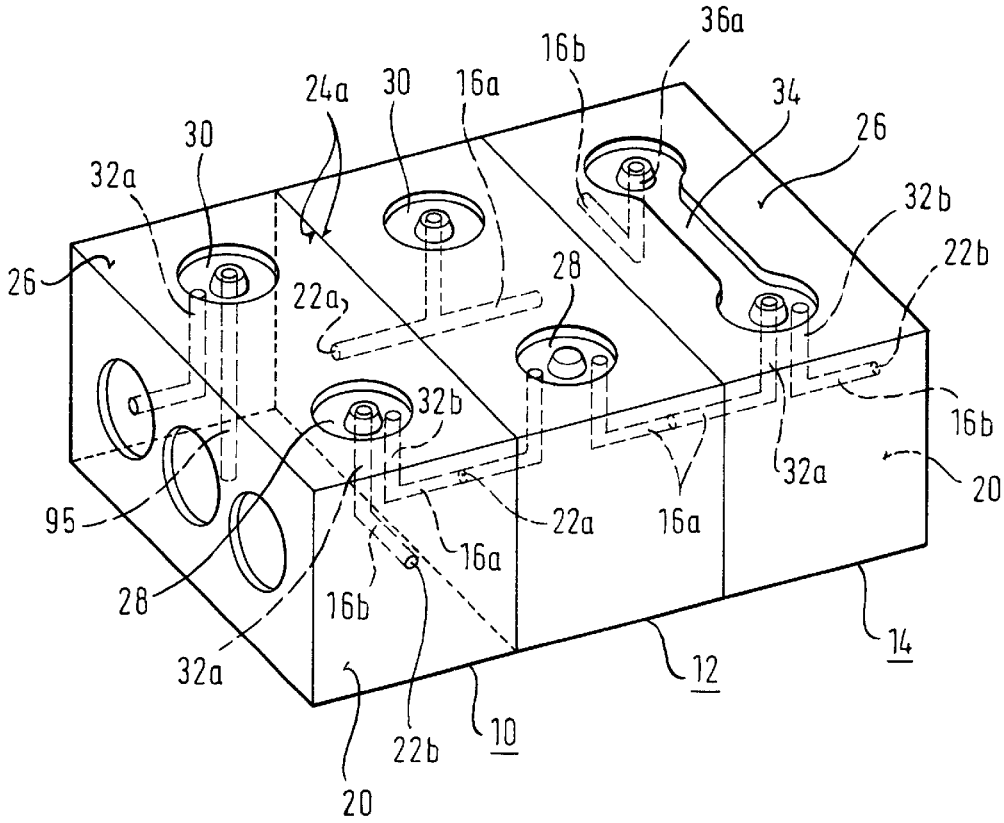
FIG. 1 shows a perspective view of three module blocks arranged in an aligned abutting relationship according to a first embodiment of the invention.
Figure 2:
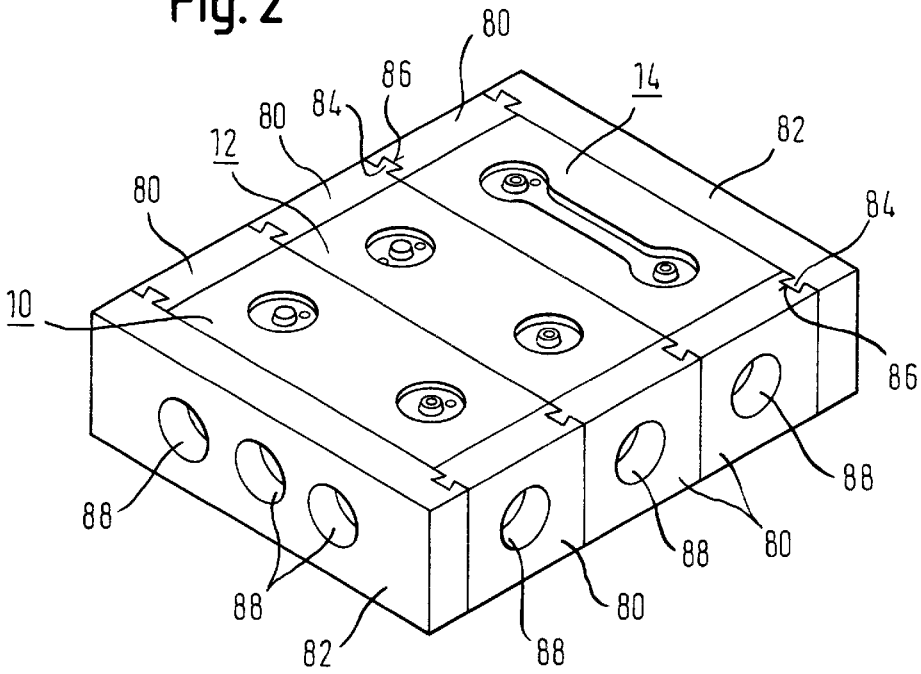
FIG. 2 shows a perspective view of the three module blocks of FIG. 1, wherein the module blocks are surrounded by a frame being assembled of a plurality of frame members.

The modular fluid control system illustrated in FIGS. 1 and 2 comprises three module blocks 10, 12, 14 which are arranged in an aligned abutting relationship, each being of a parallelepiped-shape and having essentially the same size. The module blocks are preferably produced by injection moulding. Inside the module blocks fluid channels are provided for the distribution of a fluid or different kinds of fluids. Channel sections 16*a*, 16*b* each open to one of the side surfaces 20 of the corresponding module block 10, 12, 14 where they form port openings 22*a*, 22*b*. Adjacent module blocks respectively communicate with each other at abutting porting faces 24*a* via these port openings 22*a*. The channel sections 16*b* are defined to constitute inflow channels and outflow channels. On each of the top faces 26 of the module blocks 10, 12 two fluid control spaces 28, 30 lying opposite to each other are designed into which adjacent channel sections 32*a*, 32*b* open. On the top face 26 of the module block 14 only one fluid control space 34 is designed into which adjacent channel sections 32*a*, 32*b* and a channel section 36*a* lying opposite to the channel sections 32*a*, 32*b* open. Valves can be mounted on the top faces 26 of the module blocks 10, 12, 14. Each of the valves of the module blocks 10, 12 has a closing member selectively enabling or blocking the fluid flow between the adjacent channel sections 32*a*, 32*b*. In the case of the module block 14 the valve has a closing member selectively enabling or blocking the fluid flow between the channel sections 32*a*, 32*b* and 36*a*. The valve seats cooperating with the closing member of the valves are each integrally moulded on the top faces 26 of the module blocks 10, 12, 14 surrounding selected ones of the openings of the channel sections 32*a*, 32*b*, 36*a*.

Figure 5:
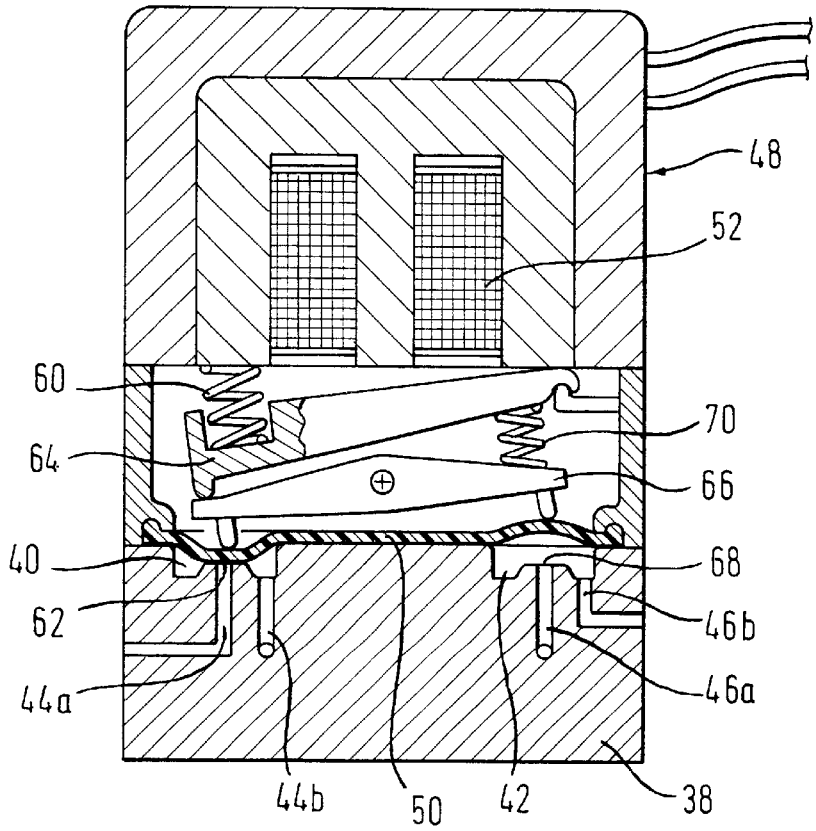
FIG. 5 shows a sectional side view of a module block with a rocker-type valve mounted on its top face.

A possible configuration of a valve which can be mounted on the top faces 26 of each of the module blocks 10, 12 is illustrated in FIG. 5: On the top face of a module block 38 two fluid control spaces 40, 42 are designed into which adjacent channel sections 44*a*, 44*b* and respectively 46*a*, 46*b* open. A rocker-type valve 48 is mounted on the module block 38 and comprises a diaphragm 50 which is able to selectively enable or block the fluid flow between the adjacent channel sections 44*a*, 44*b* and the adjacent channel sections 46*a*, 46*b*, respectively. The rocker-type valve 48 is actuated by a solenoid 52. In the absence of current the force of a restoring spring 60 causes the diaphragm 50 to close the opening 62 of the channel section 44*a* thus blocking the fluid flow between the channel sections 44*a* and 44*b*. The openings of the adjacent channel sections 46*a*, 46*b* are not closed by the diaphragm 50 so that fluid can flow between the channel sections 46*a*, 46*b* via the fluid control space 42. If a voltage is applied to the solenoid 52, a magnetic field is generated which causes an armature 64 which is connected to a rocker 66 to be moved upwards against the force of the restoring spring 60. As a result the diaphragm 50 frees the opening 62 of the channel section 44*a* and the right-hand side of the rocker 66 together with the membrane 50 is moved towards the opening 68 of the channel section 46*a* by the force of a pressure spring 70, so that the fluid flow between the adjacent channel sections 46*a*, 46*b* is blocked.

The module blocks 10, 12, 14 are surrounded by a frame which is assembled of a plurality of frame members 80, 82 wherein adjacent frame members are connected to each other by means of tenons 84 and complementary recesses 86 to form dovetail connections. The frame members consist of a pair of end members 82 and a plurality of side members 80. Each of the frame members 80, 82 is provided with at least one connector through port 88, each connector through port 88 communicating with a corresponding port opening 22*a* of the module blocks 10, 12, 14.

Figure 3:
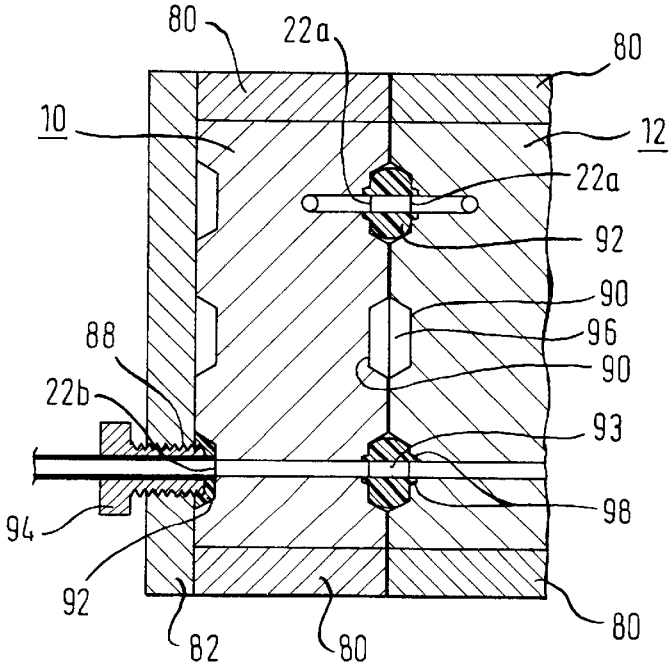
FIG. 3 shows in a sectional view of FIG. 2 the connection between the port openings of adjacent module blocks and the connector through port of a frame member with a connector plug arranged therein.

Such a connection according to the invention between a connector through port 88 of an end member 82 and a port opening 22*b* of the module block 10 is illustrated in FIG. 3.

Also illustrated in FIG. 3 is a connection between the port openings 22*b* of the adjacent module blocks 10, 12. Each of the port openings 22*a*, 22*b* is formed in one of a plurality of recesses 90 designed in side faces 20 of the module blocks 10, 12, 14. In order to achieve a fluid-tight connection between the port openings 22*a* a seal member 92 with a through hole 94 is located in a cavity 96 formed by the abutting recesses 90 of two adjacent module blocks. The seal member 92 comprises sealing lips 98 towards the fluid carrying channel. As the recesses 90 are designed in pairs lying in two opposing faces of the module blocks, it is possible to assemble each of the module blocks 10, 12, 14 with its adjacent module block, or blocks, in one of two orientations mutually turned by 180°. The connector through port 88 of the end member 82 is provided with a thread and is configured so as to be usable with conventional connector plugs. The connector plug 94 abuts at its end facing the module block 10 against the seal member 92 in a fluid-tight manner.

The modular fluid control system illustrated in FIGS. 1 and 2 can be used for both distribution and mixing processes. In the distribution mode the valve mounted on the module block 10 opens for enabling fluid flow from the inflow channel 16*b* to the channel section 32*b* via the channel section 32*a* of the module block 10. If the valve mounted on the module block 12 which enables or blocks the fluid flow between the adjacent channel sections 32*a*, 32*b* formed inside the module block 12 is open, the fluid is directed via these channel sections 32*a*, 32*b* to the channel section 16*a* of the module block 14. By opening the valve mounted on the module block 14, the fluid is directed to the outflow channels 16*b* via the adjacent channel sections 32*a*, 32*b* and the fluid control space 34 thus distributing the fluid in two different directions.

If, vice versa, it is intended to use the two channel sections 16*b* of the module block 14 as inflow channels, the same configuration can be used for the mixing of two different fluids.

If the module block 10 is turned by 180° with respect to the adjacent module block 12 the function of the channel 16*b* which can be used as inflow or outflow channels and open to a side face 20 is assumed by a channel 96 opening to the bottom face of the module block 10. In this case an additional end member is required as is explained in more detail in the following with reference to FIG. 4.

Figure 4:
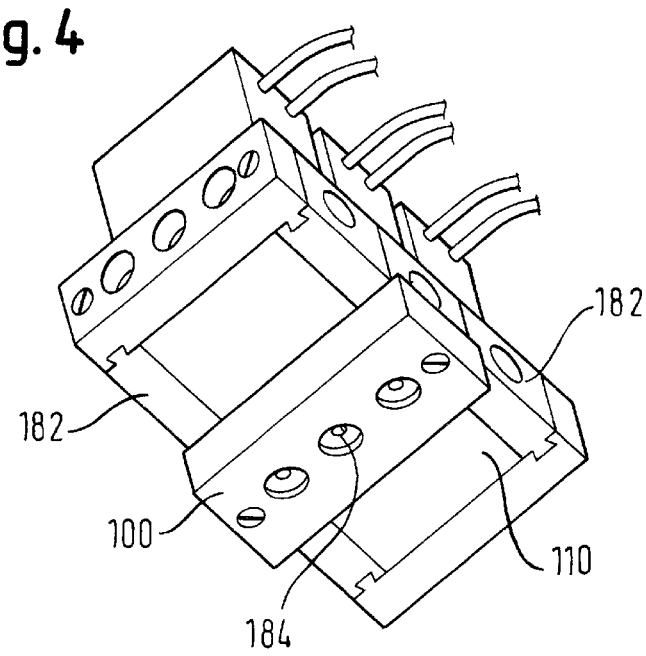
FIG. 4 shows a perspective view of a modular fluid control system according to a second embodiment of the invention, with modular blocks being arranged in an aligned abutting relationship.

According to the embodiment illustrated in FIG. 4 an end member 100 is attached underneath the module blocks 110 to the side members 182 of one of the module blocks 110. The end member 100 is provided with connector through ports 184 thus enabling the connection of connector plugs from the bottom of the module blocks 110.

Figure 6A:
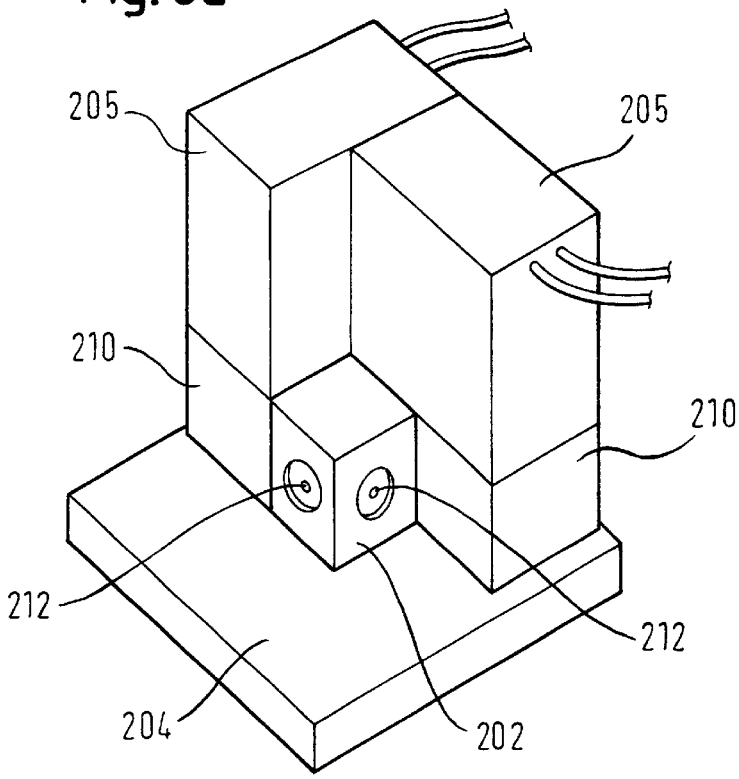
FIG. 6*a* shows a perspective view of a modular fluid control system according to a third embodiment of the invention, with module blocks being concentrically arranged on a common manifold base.
Figure 6B:
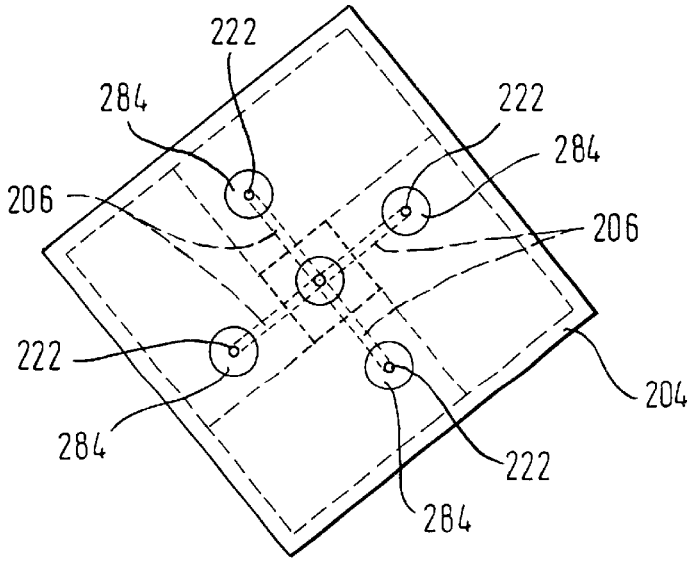
FIG. 6*b* shows a schematic bottom view of the modular fluid control system of FIG. 6*a,*

According to the embodiment illustrated in FIGS. 6*a* and 6*b* four parallelepiped-shaped module blocks 210 (of which only two are shown) having all essentially the same size are concentrically arranged around a central block 202 on a common manifold base 204. On the top faces of the module blocks 210 valves 205 are mounted to control the flow of fluid within the module blocks 210. Inside each module block 210 a fluid channel 206 is provided which each opens to the bottom face of the corresponding module block 210 thus forming port openings 222. The common manifold base 204 is also provided with port openings which each communicate with a corresponding port opening 222 of the module blocks 210. At the bottom face of the common manifold base 204 connector through ports 284 are provided which are intended for the accommodation of connector plugs. The module blocks 210 each communicate with the central block 202 via openings which are provided in the side faces of the central block.

Different control functions of the modular fluid control systems can be achieved by simply exchanging the common manifold base. Different manifold bases may for example differ in the arrangement and number of the port openings thus requiring a different number of module blocks which are arranged in a different orientation with respect to each other.

Figure 7:
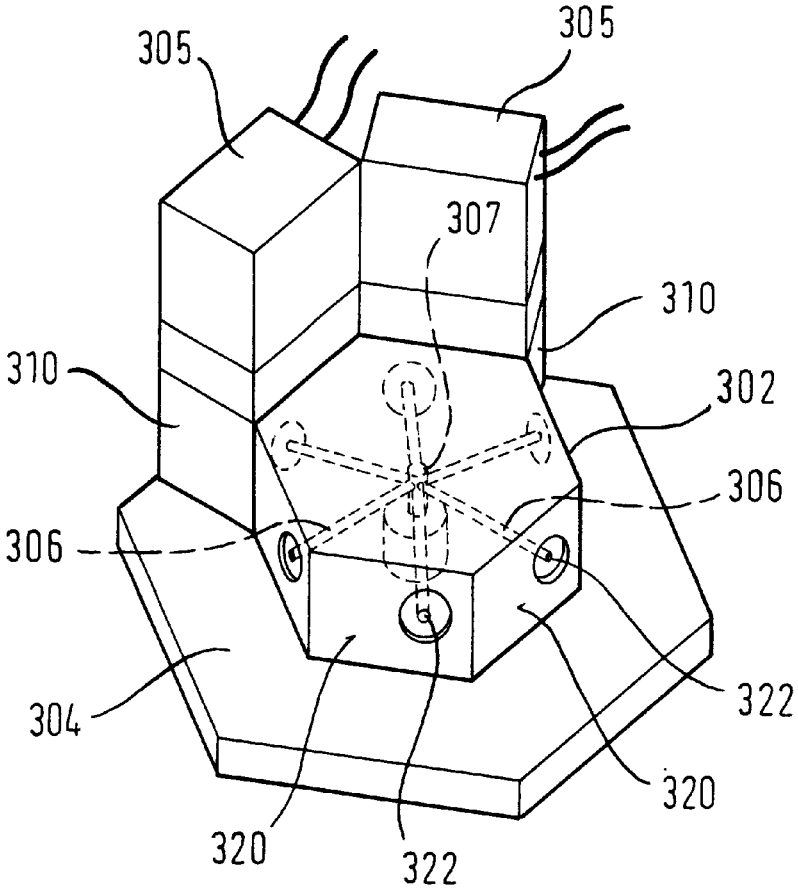
FIG. 7 shows a perspective view of a modular fluid control system according to a fourth embodiment of the invention with module blocks being concentrically arranged about a central manifold block.

According to the embodiment illustrated in FIG. 7 six module blocks 310 (of which only two are shown) are concentrically arranged about a manifold block 302 on a common base 304. On the top faces of the module blocks 310 valves 305 are mounted to control the flow of fluid within the module blocks 310. The peripheral faces of the manifold block 302 facing the module blocks 310 have the function of porting faces 320 abutting corresponding porting faces of the module blocks 310. Inside the manifold blocks 310 fluid channels 306 are provided each opening on a porting face 320 to form port openings 322. The fluid channels merge into a common channel 307 formed inside the manifold block 302.

With this embodiment different control functions of the modular fluid control system can be achieved by simply exchanging the central manifold block, for example by using a central manifold block with a different flow of the fluid channels.

The modular fluid control systems illustrated in FIGS. 6 and 7 can be used for both mixing and distributing processes. If the fluid is directed from the module blocks 210, 310, respectively, into the central block 202, 302, respectively, the modular systems can be used for mixing different fluids. If the fluid is directed from the central block 202, 302, respectively into each module block 210, 310, respectively, the modular system can be used for the distribution of a fluid.

As the module blocks are each formed of similar shape and size they can be produced in the same die mould. Differences with respect to the design of the fluid channels which are formed within the module blocks can be achieved by subsequently providing the module blocks with individual bores.

What is claimed is:

1. A modular fluid control system comprising a plurality of fluid distribution modules each formed of a parallelepiped-shaped module block of similar shape and size and having fluid channels therein, each module block having at least two porting faces on opposite sides, selected ones of said channels opening on an associated one of said porting faces to form port openings, said module blocks being arranged in an aligned abutting relationship so that selected port openings communicate with each other at abutting porting faces of adjacent module blocks, said module blocks forming a pair of side faces and a pair of end faces of said modular fluid control system, said modular fluid control system further comprising a frame surrounding said module blocks and having connector through ports therein aligned with selected ones of said port openings, said frame being assembled of a plurality of inter-engaged frame members, said frame members comprising a pair of end members arranged at said end faces and a plurality of side members arranged at each of said side faces, and said side and end members each being configured of same size and shape.

2. The modular fluid control system of claim 1, wherein said frame members comprise an additional end member connected to selected ones of said side members.

3. The modular fluid control system of claim 1, wherein each of said module blocks has a bottom face, a top face and side faces interconnecting said top and bottom faces, each of said side faces being a potential porting face.

4. The modular fluid control system of claim 3, wherein said top face is a porting face.

5. The modular fluid control system of claim 3, wherein said top face is an interface to a modular valve mounted on said modular block to control flow of fluid through channels within said module blocks.

6. The modular fluid control system of claim 1, wherein said through ports in said frame members are internally threaded for accommodation of threaded connector plugs.

7. The modular fluid control system of claim 1, wherein at least selected ones of said module blocks are adapted to be selectively assembled with adjacent module blocks in one of two orientations mutually turned by 180°.

8. The modular fluid control system of claim 1, wherein said module blocks are each configured in the form of injection moulded parts.

9. A modular fluid control system comprising a plurality of fluid distribution modules each formed of a parallelepiped-shaped module block of similar shape and size and having fluid channels therein, each module block having at least two porting faces on opposite sides, selected ones of said channels opening on an associated one of said porting faces to form port openings, said module blocks being arranged in an aligned abutting relationship so that selected port openings communicate with each other at abutting porting faces of adjacent module blocks, and further comprising a frame surrounding said module blocks and having connector through ports therein aligned with selected ones of said port openings, each of said module blocks having a bottom face, a top face and side faces interconnecting said top and bottom faces, each of said side faces being a potential porting face, said top face being an interface to a modular valve mounted on said modular block to control flow of fluid through channels within said module blocks and having at least one integrally moulded valve seat surrounding a channel opening.

10. A modular fluid control system comprising a plurality of fluid distribution modules each formed of a parallelepiped-shaped module block of similar shape and size and having fluid channels therein, each module block having at least two porting faces on opposite sides, selected ones of said channels opening on an associated one of said porting faces to form port openings, said module blocks being arranged in an aligned abutting relationship so that selected port openings communicate with each other at abutting porting faces of adjacent module blocks, and further comprising a frame surrounding said module blocks and having connector through ports therein aligned with selected ones of said port openings, each of said module blocks having a bottom face, a top face and side faces interconnecting said top and bottom faces, each of said side faces being a potential porting face, said top face being an interface to a modular valve mounted on said modular block to control flow of fluid through channels within said module blocks, adjacent channel sections opening into a fluid control space defined at said top face and said valve has a closure member selectively enabling or blocking fluid flow between said channel sections.

11. A modular fluid control system comprising a plurality of fluid distribution modules each formed of a parallelepiped-shaped module block of similar shape and size and having fluid channels therein, each module block having at least two porting faces on opposite sides, selected ones of said channels opening on an associated one of said porting faces to form port openings, said module blocks being arranged in an aligned abutting relationship so that selected port openings communicate with each other at abutting porting faces of adjacent module blocks, and further comprising a frame surrounding said module blocks and having connector through ports therein aligned with selected ones of said port openings, each of said module blocks having a bottom face, a top face and side faces interconnecting said top and bottom faces, each of said side faces being a potential porting face, said top face being an interface to a modular valve mounted on said modular block to control flow of fluid through channels within said module blocks, a pair of fluid control spaces being defined in said top face at mutually spaced locations, a pair of channel sections opening into each of said fluid control spaces, and said valve having a rocker-type actuating member carrying a pair of closure members, each closure member selectively enabling or blocking fluid flow between an associated pair of channel sections.

12. A modular fluid control system comprising a plurality of fluid distribution modules each formed of a parallelepiped-shaped module block of similar shape and size and having fluid channels therein, each module block having at least two porting faces on opposite sides, selected ones of said channels opening on an associated one of said porting faces to form port openings, said module blocks being arranged in an aligned abutting relationship so that selected port openings communicate with each other at abutting porting faces of adjacent module blocks, and further comprising a frame surrounding said module blocks and having connector through ports therein aligned with selected ones of said port openings, said through ports in said frame members being internally threaded for accommodation of threaded connector plugs and said port openings being formed in recesses of said porting faces, seal members with a through hole being arranged in said recesses.

13. The modular fluid control system of claim 12, wherein said connector plugs abut said seal members in a fluid-tight manner.

* * * * *